US010931053B2

(12) United States Patent
Thomas

(10) Patent No.: US 10,931,053 B2
(45) Date of Patent: Feb. 23, 2021

(54) EXPANDABLE ELECTRICAL DEVICE COVER

(71) Applicant: Hubbell Incorporated, Shelton, CT (US)

(72) Inventor: Jason Thomas, Mesa, AZ (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/381,651

(22) Filed: Apr. 11, 2019

(65) Prior Publication Data

US 2019/0319391 A1 Oct. 17, 2019

Related U.S. Application Data

(60) Provisional application No. 62/656,125, filed on Apr. 11, 2018.

(51) Int. Cl.
*H01R 13/44* (2006.01)
*H01R 13/447* (2006.01)
*H01R 13/52* (2006.01)

(52) U.S. Cl.
CPC ..... *H01R 13/447* (2013.01); *H01R 13/5213* (2013.01)

(58) Field of Classification Search
CPC ..... H01R 13/447; H01R 13/5213
USPC ..... 439/142, 373, 535
See application file for complete search history.

(56) References Cited

U.S. PATENT DOCUMENTS 5,174,773 A * 12/1992 Jones ..... H01R 13/447 174/67
6,133,531 A * 10/2000 Hayduke ..... H02G 3/081 174/67
6,891,104 B2 * 5/2005 Dinh ..... H02G 3/088 174/375
7,071,415 B1 * 7/2006 Shotey ..... H02G 3/14 174/66
7,396,996 B1 * 7/2008 Shotey ..... H02G 3/14 174/67
7,462,777 B2 * 12/2008 Dinh ..... H01R 13/5213 174/58
7,626,121 B1 * 12/2009 Cleghorn ..... H02G 3/14 174/53
8,106,295 B1 * 1/2012 Shotey ..... H02G 3/14 174/66
8,153,895 B2 * 4/2012 Drane ..... H02G 3/14 174/66
8,350,148 B1 * 1/2013 Shotey ..... H02G 3/123 174/50
8,921,695 B2 * 12/2014 Drane ..... H02G 3/185 174/66
9,203,222 B2 * 12/2015 Korcz ..... H02G 3/088
2004/0102072 A1 * 5/2004 Plattner ..... H01R 13/514 439/215

(Continued)

*Primary Examiner* — Abdullah A Riyami
*Assistant Examiner* — Nelson R. Burgos-Guntin
(74) *Attorney, Agent, or Firm* — Michael Best & Friedrich, LLP

(57) ABSTRACT

An enclosure for providing access to an electrical outlet includes a base with an aperture configured to couple to the electrical outlet and a lid coupled to the base. The lid selectively covers the aperture and includes a frame and an expandable section. The expandable section is moveable relative to the frame and selectively increases the volume of the lid.

18 Claims, 8 Drawing Sheets

(56) References Cited

U.S. PATENT DOCUMENTS

| | | | | |
|---|---|---|---|---|
| 2005/0082081 | A1* | 4/2005 | Marcou | H02G 3/088 174/67 |
| 2008/0223601 | A1* | 9/2008 | Johnson | H02G 3/14 174/67 |
| 2008/0296039 | A1* | 12/2008 | Dinh | H02G 3/14 174/58 |
| 2010/0120276 | A1* | 5/2010 | White | H02G 3/14 439/148 |
| 2011/0244713 | A1* | 10/2011 | Ihde | H01R 13/5808 439/460 |
| 2014/0113467 | A1* | 4/2014 | Senatori | H01R 13/447 439/142 |
| 2014/0370732 | A1* | 12/2014 | Curtis | H01R 24/28 439/142 |
| 2016/0064850 | A1* | 3/2016 | Draper, Jr. | H01R 13/516 439/137 |
| 2017/0237198 | A1* | 8/2017 | Sathyanarayana | H01R 25/006 439/105 |
| 2019/0319391 | A1* | 10/2019 | Thomas | H01R 13/447 |

* cited by examiner

EXPANDABLE ELECTRICAL DEVICE COVER

CROSS-REFERENCE TO RELATED APPLICATION

This application claims the benefit of U.S. Provisional Patent Application No. 62/656,125, filed Apr. 11, 2018, the entire contents of which are incorporated by reference herein.

FIELD

Embodiments relate to a cover for an electrical device and, more specifically, to an expandable portion of the cover.

SUMMARY

One embodiment discloses an enclosure for providing access to an electrical outlet that includes a base with an aperture configured to couple to the electrical outlet and a lid coupled to the base. The lid selectively covers the aperture and includes a frame and an expandable section. The expandable section is moveable relative to the frame and selectively increases the volume of the lid.

Another embodiment discloses an enclosure for providing access to an electrical outlet that includes a base with an aperture configured to couple to the electrical outlet and at least one selected from a group consisting of a male hinge portion and a female hinge portion. The enclosure also includes a lid with a flexible portion and a rigid portion. The flexible portion is moveable with respect to the rigid portion. The other of the male hinge portion and the female hinge portion is coupled to the rigid portion. The male hinge portion is snapped into the female hinge portion to pivotably couple the lid to the base.

Yet another embodiment discloses an enclosure for providing access to an electrical outlet that includes a base with an aperture configured to couple to the electrical outlet and a lid pivotably coupled to the base. The lid selectively covers the aperture and includes a frame and an expandable section. The expandable section is moveable relative to the frame and selectively increases a volume of the lid in order to accommodate a cord configured to electrically connect with the electrical outlet.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the disclosure relates to an electrical cover configured to receive an electrical device. The electrical cover includes an expandable portion configured to change a volume of the electrical cover.

Figure 1:
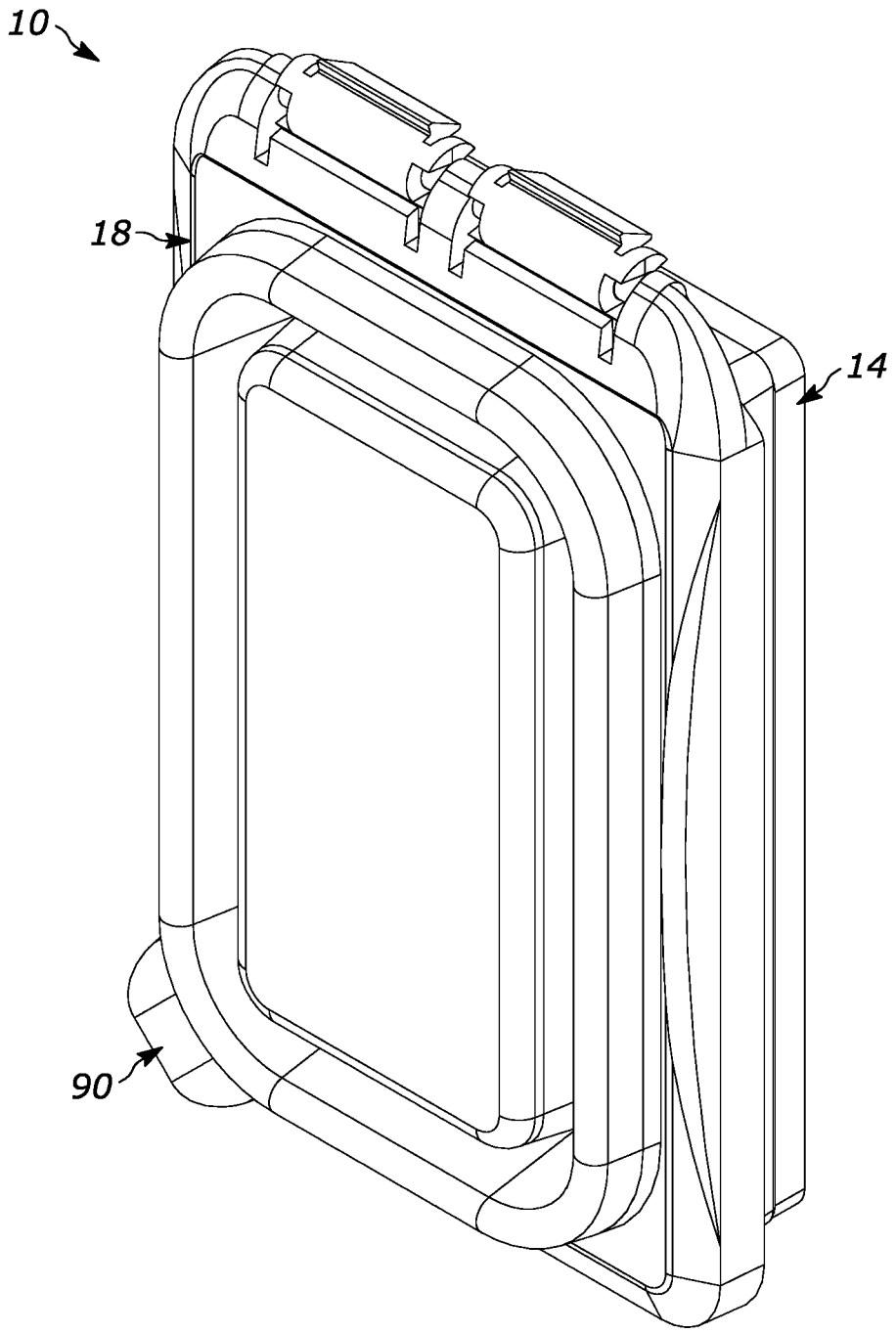
FIG. 1 is a perspective view of an electrical cover according to some embodiments.
Figure 2:
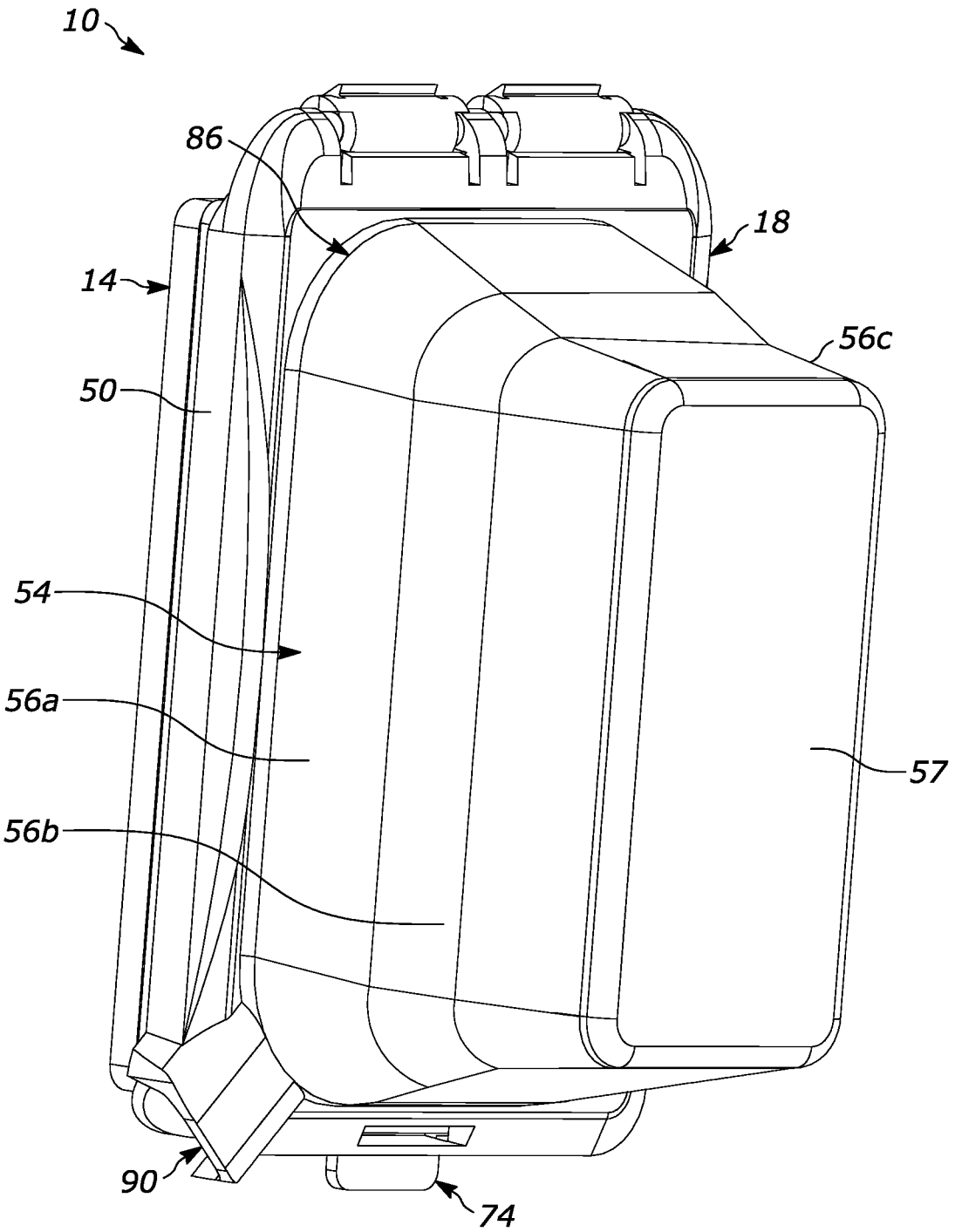
FIG. 2 is a second perspective view of the electrical cover of FIG. 1, illustrating an expanded section in an open position, according to some embodiments.

As shown in FIGS. 1 and 2, an electrical cover 10 includes a base 14 and a lid 18. The base 14 and the lid 18 are substantially rectangular in shape. In the illustrated embodiment, the lid 18 is wider and longer than the base 14.

Figure 3:
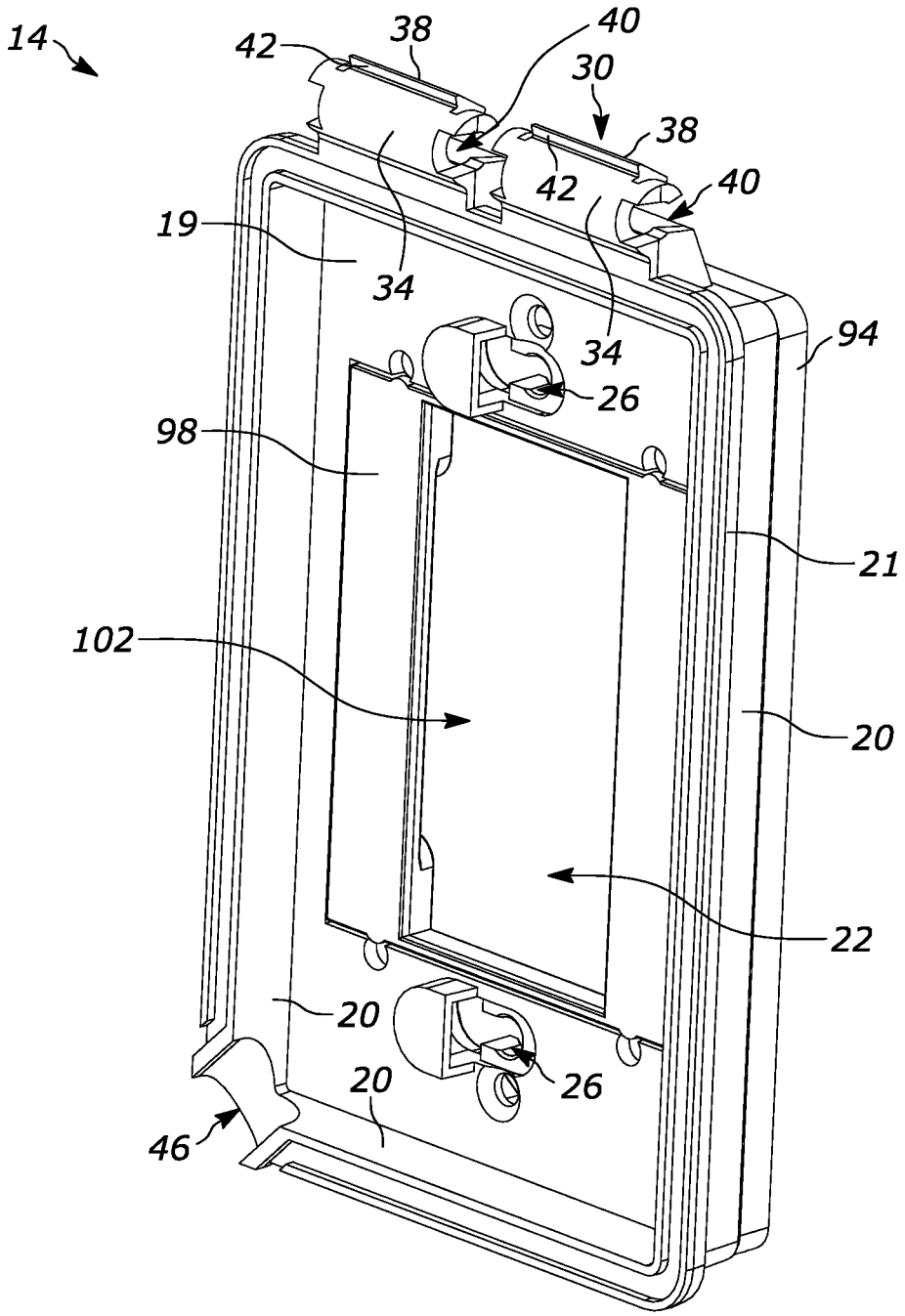
FIG. 3 is a perspective view of a base of the electrical cover of FIG. 1 according to some embodiments.
Figure 4:
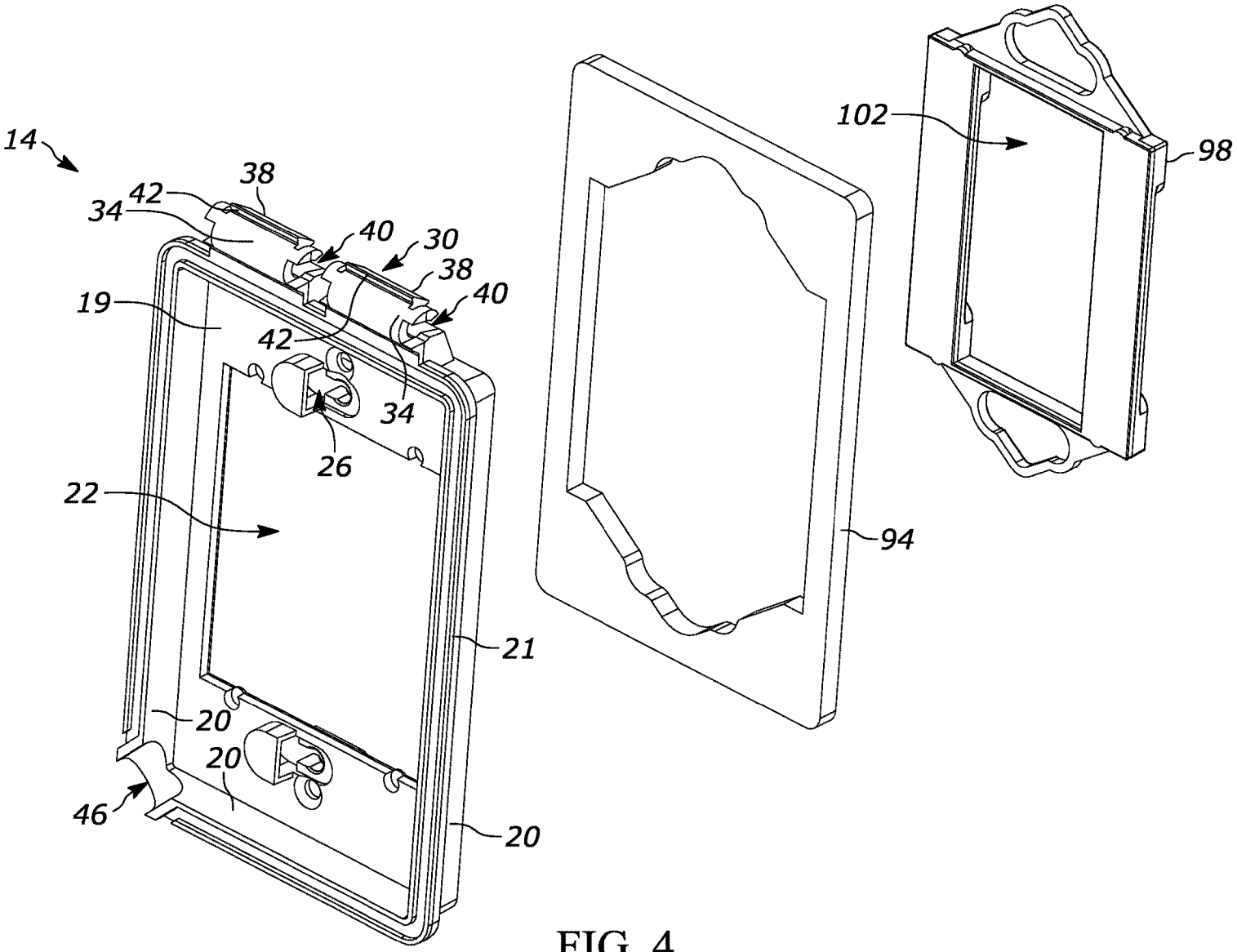
FIG. 4 is an exploded view of the base of the electrical cover of FIG. 3 according to some embodiments.

As shown in FIGS. 3 and 4, the base 14 includes an end wall 19 and side walls 20 extending away from the end wall 19 to define a base volume. A top of the side walls 20 (i.e., distal the end wall 19) may include a lip 21. In the illustrated embodiment, the lip 21 traverses the entire perimeter of the base 14. The end wall 19 may include an aperture 22. In the illustrated embodiment, the aperture 22 is substantially rectangular in shape and centered on the base 14. The end wall 19 further includes fastening apertures 26 disposed proximate the aperture 22. In the illustrated embodiment, the end wall 19 includes two fastening apertures 26. The fastening apertures are disposed symmetrically proximate opposite sides of the aperture 22.

A spacer 94 is coupled to one side of the base 14. The spacer 94 provides the base 14 with additional thickness. A fitting 98 having an opening 102 is coupled to the base 14, proximate to the aperture 22. A surface of the fitting 98 is disposed within the aperture 22, so that an effective area of the aperture 22 is equivalent to an area of the opening 102. In the illustrated embodiment, the spacer 94 is removably coupled to the base 14; although in other embodiments, the spacer 94 may be integrally formed with the base 14. Additionally, the fitting 98 is removably coupled to the base 14; although in other embodiments, the fitting 98 may be integrally formed with the base 14.

The base 14 also includes a first channel 46. The first channel 46 is substantially semi-cylindrical in shape. In the illustrated embodiment, the first channel 46 is disposed proximate a corner of the base 14 and extends through two adjacent side walls 20. An edge of the first channel 46 also extends beyond the side walls 20.

A female hinge component 30 is coupled to an opposite edge of the base 14 than the first channel 46. In the illustrated embodiment, the female hinge component 30 is made up of two C-shaped members 34. The C-shaped members 34 are spaced apart from one another and disposed an equivalent distance from a center of the base 14. A projection 38 is disposed on an exterior of the each of the C-shaped members 34 and inclined with respect to a center of each C-shaped member 34. Each projection 38 extends tangentially along a length of the C-shaped member 34. In the illustrated embodiment, the projection 38 is disposed proximate, and extends past, an opening 40 of the C-shaped member 34. The projection 38 is rounded proximate the opening 40 of the C-shaped member 34 and includes a stop surface 42 distal the opening 40 of the C-shaped member 34. The stop surface 42 extends long a height of the projection 38. In the illustrated embodiment, the stop surface 42 is oblique with respect to the edge of the base 14 coupled to the C-shaped members 34.

Figure 5:
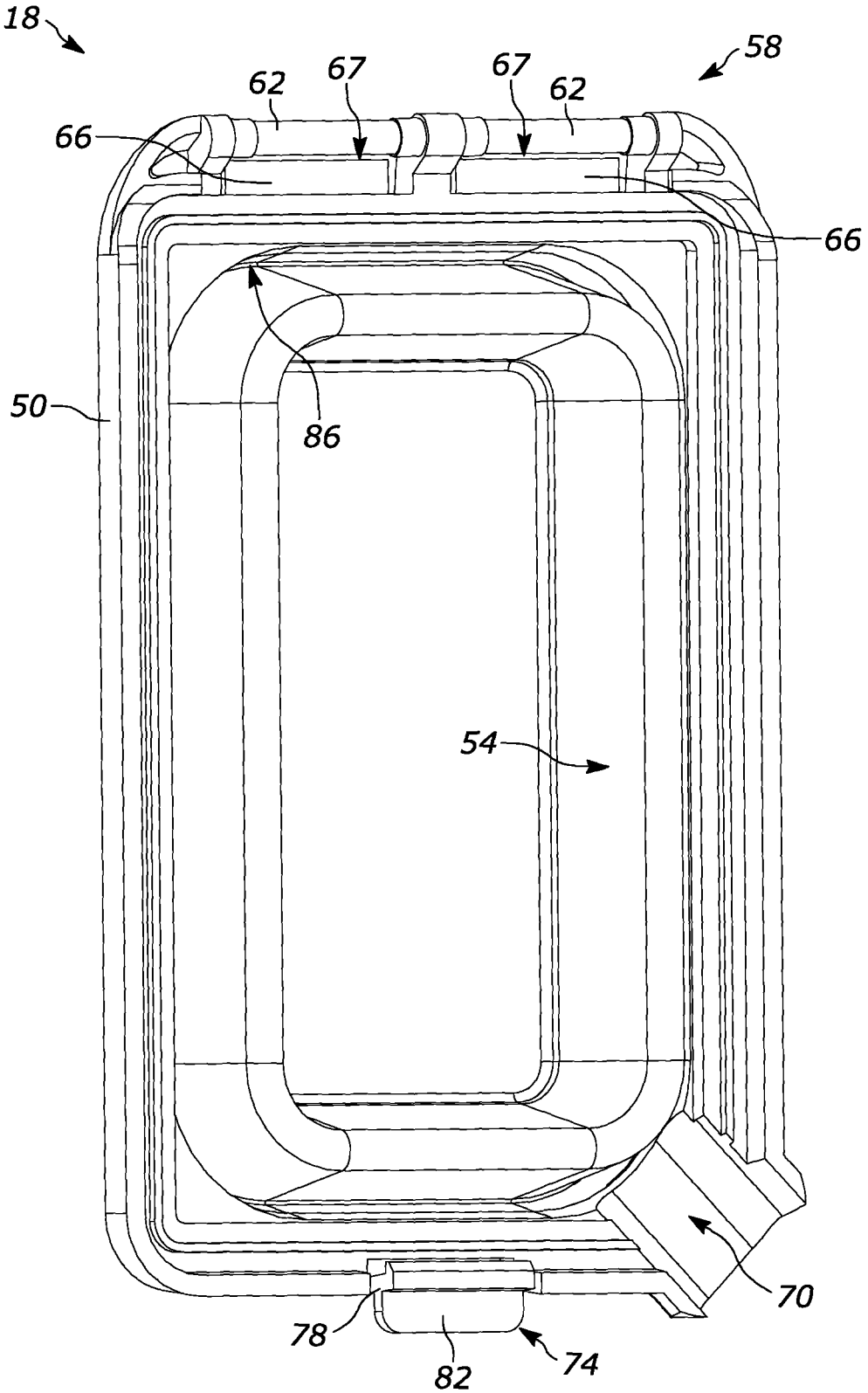
FIG. 5 is a perspective view of a lid of the electrical cover of FIG. 1 according to some embodiments.

As shown in FIG. 5, the lid 18 includes a frame 50 and a movable or expandable portion 54. The frame 50 is substantially rectangular in shape and is made from a rigid material (e.g., hard plastic or similar material). A male hinge component 58 is disposed along one end of the frame 50. In the illustrated embodiment, the male hinge component 58 is made up of two rods 62 that are substantially cylindrical in shape and spaced apart from the frame 50. The rods 62 are also spaced apart from one another and disposed an equivalent distance from a center of the frame 50.

Projections 66 are disposed on the frame 50 proximate each of the rods 62. A gap 67 is disposed between the projections 66 and respective rods 62. In the illustrated embodiment, the projections 66 are rectangular in shape and have a thickness less than the thickness of the frame 50. The projections 66 also have a length approximately equivalent to a length of the rods 62. Each projection 66 includes a planar surface 68 (see e.g., FIG. 6) parallel an edge of the frame 50.

In the illustrated embodiment, the frame 50 includes a second channel 70 that is substantially semi-cylindrical in shape. The second channel 70 extends through walls of the frame 50. An edge of the second channel 70 also extends beyond outer edges of the frame 50.

A latch 74 is coupled to an edge of the frame 50 proximate the second channel 70 (i.e., opposite the male hinge component 58). The latch 74 includes an engagement piece 78 and an interface 82 connected with, and oriented substantially orthogonally with respect to, the engagement piece 78. In the illustrated embodiment, the engagement piece 78 is L-shaped and configured to engage another surface in order to couple the lid 18 in place. The interface 82 is movable (e.g., bendable) with respect to the frame 50. The engagement piece 78 is configured to move with the interface 82.

The frame 50 includes a central portion 86 that is substantially rectangular in shape and has a greater area than the aperture 22 (FIG. 2). The expandable portion 54 is disposed within the central portion 86. In the illustrated embodiment, the expandable portion 54 is formed using injection molding and is over molded onto the frame 50. The expandable portion 54 is made from a flexible material (e.g., plastic, silicone, etc.). The expandable portion 54 is also disposed on either side of the frame 50 (i.e., the expandable portion 54 extends through the central portion 86 so that part of the expandable portion 54 extends past the frame 50 on either side of the central portion 86 (FIGS. 1 and 5)).

The expandable portion 54 is moveable with respect to the frame 50. As shown in FIG. 2, the expandable portion 54 has a tiered structure, with each tier 56 having a trapezoidal profile. Tops and bottoms of each tier 56 are generally rectangular and sides of the tiers 56 are inclined so that the tops have an area less than the bottoms. In the illustrated embodiment, the expandable portion 54 has three tiers 56. A first tier 56*a* is coupled to the frame 50. A second tier 56*b* is coupled to the first tier 56*a* and coupled to a third tier 56*c* so that the second tier 56*b* is disposed between the first and third tiers 56*a*, 56*c* while the expandable portion 54 is in an open position (FIG. 2). In other embodiments, the expandable portion 54 may have more or less tiers 56.

In a closed position (see e.g., FIGS. 1 and 5), the expandable portion 54 is collapsed on itself. Boundaries between each of the tiers 56*a*-56*c* act as fold lines, allowing the tiers 56*a*-56*c* to fold into the closed position. The tiers 56*a*-56*b* fold in an alternating pattern (i.e., each tier 56*a*-56*c* folds in the opposite direction as the successive tier 56*a*-56*c*). The first tier 56*a* folds through the central portion 86 in a first direction with respect to the frame 50. The second tier 56*b* folds back through the central portion 86, with respect to the first tier 56*a*, in a second direction opposite the first direction. The third tier 56*c* folds in the first direction with respect to the second tier 56*b*. The folding pattern causes the expandable portion 54 to protrude past either side of the frame 50. Each tier 56*a*-56*c* is independently foldable so that some, but not all of the tiers 56*a*-56*c* are in the open position (see e.g., FIG. 2) and the closed position (see e.g., FIG. 1). For example, the first and second tiers 56*a*, 56*b* may be expanded to the open position, while the third tier remains in the closed position, and is folded back into the second tier 56*b*.

An end 57 is coupled to the top of the third tier 56*c*. The end 57 is a solid piece of material encloses a portion of the expandable portion 54. A user may grab the end 57 to move the expandable portion 54 between the open position (see e.g., FIG. 2) and the closed portion (see e.g., FIG. 1).

Figure 6:
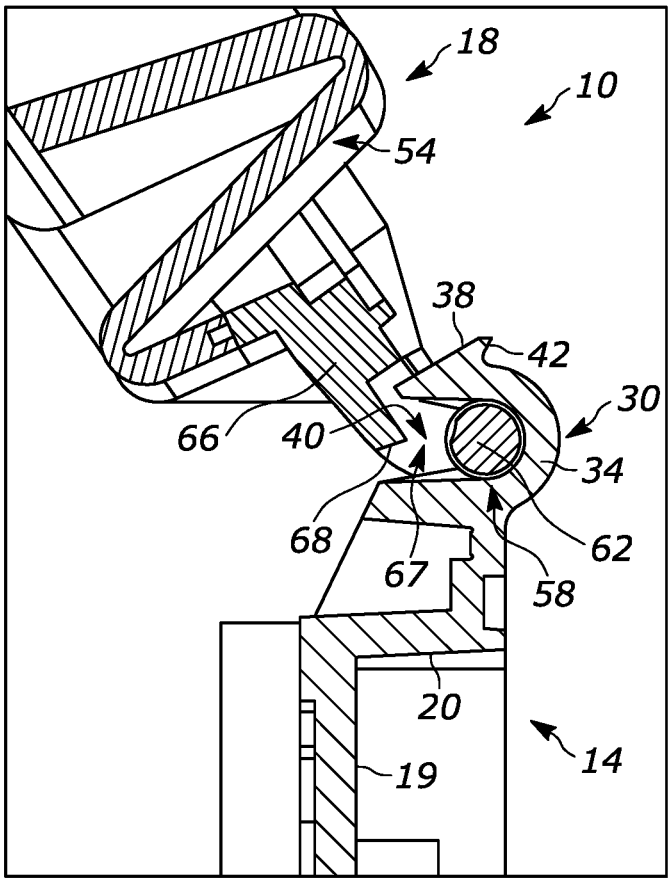
FIG. 6 is a cross-sectional view of the lid coupled to the base of FIG. 3 according to some embodiments.

As shown in FIG. 6, the male hinge component 58 is receivable within the female hinge component 30 so that the lid 18 is rotatably coupled to the base 14. Each rod 62 is receivable within the opening 40 of one of the C-shaped members 34. The planar surface 68 of each projection 66 is positioned proximate the rounded portion of the projection 38 when the rods 62 are first received within the openings 40.

Figure 7:
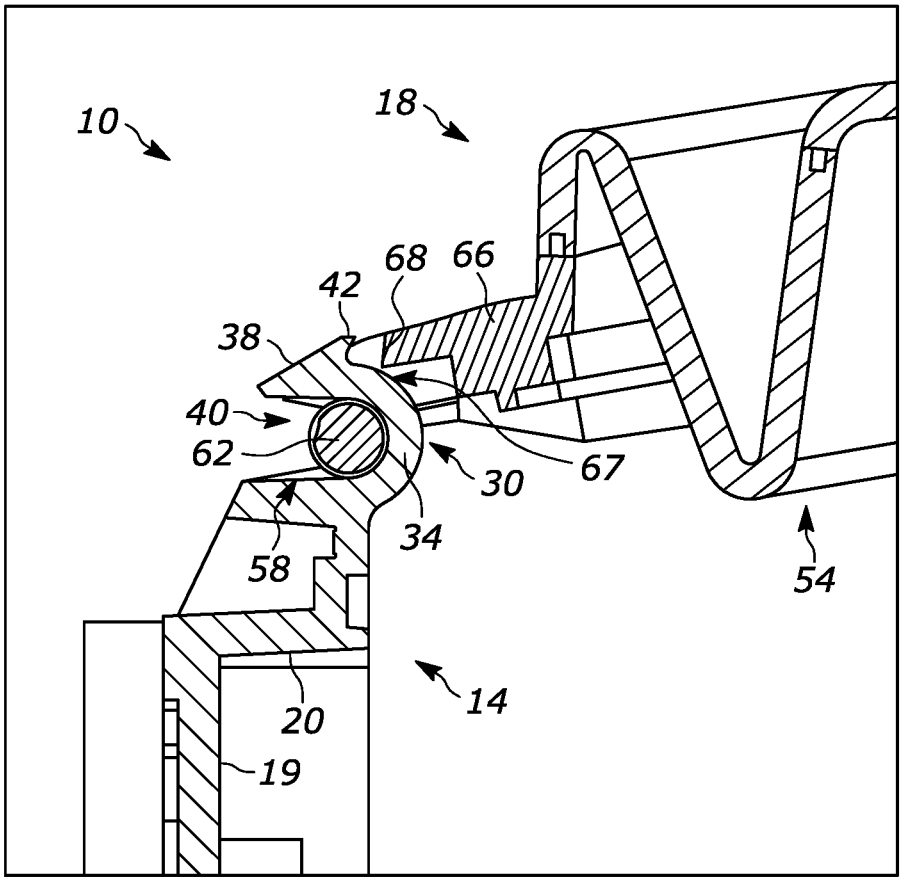
FIG. 7 is a cross-sectional view of the lid of FIG. 5 secured to the base with a one-way snap-fit according to some embodiments.

As shown in FIG. 7, the lid 18 is rotated in a first rotational direction (e.g., clockwise) with respect to the base 14. Rotation of the lid 18 in the first rotational direction causes the projections 38 to move proximate the gap 67. The inclination of the projections 38 (i.e., away from the opening 40) allows the projections 38 to pass through the gap 67 as the lid 18 continues to rotate with respect to the base 14. The lid 18 and the base 14 are fully engaged once the projections 38 have passed through the gap 67. The male hinge component 58 and the female hinge component 30 engage with a snap-fit connection to couple the base 14 and the lid 18 together, while also providing rotational freedom to the lid 18 with respect to the base 14.

The lid 18 may continue to rotate in the first direction until the latch 74 contacts the base 14. The engagement piece 78 (see e.g., FIG. 5) engages the lip 21 (see e.g., FIG. 3) so that the lip 21 rests on the engagement piece 78 (not shown). In this position, the lid 18 is locked with respect to the base 14 (i.e., the lid 18 cannot rotate with respect to the base 14) and the lid 18 covers the aperture 22. The second channel 70 is also aligned with the first channel 46 creating a cavity 90 (see e.g., FIGS. 1 and 2) that is substantially cylindrical in shape. The interface 82 is moveable in a second rotation direction (e.g., opposite the first rotational direction) to move the engagement piece 78 with respect to the lip 21. Movement of the interface 82 spaces the engagement piece 78 apart from the lip 21 so that the lid 18 is no longer locked with respect to the base 14, and is once again able to pivot with respect to the base 14.

Figure 8:
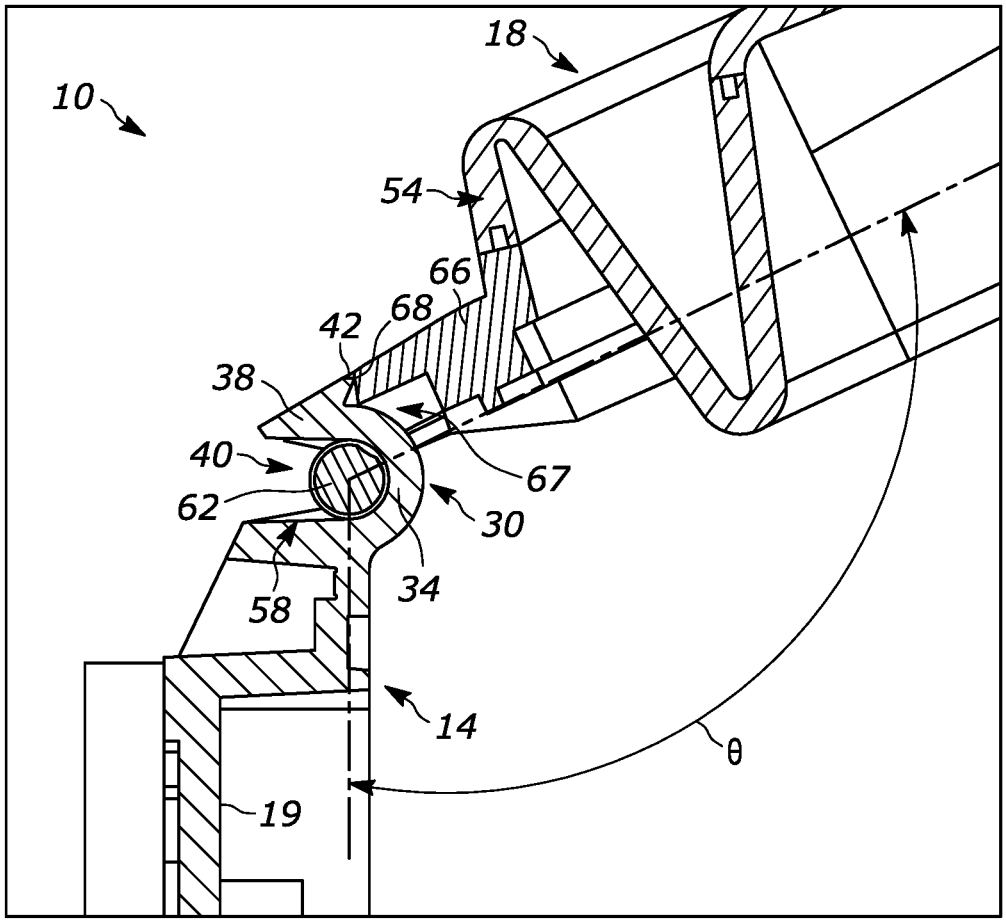
FIG. 8 is a cross-sectional view of the lid of FIG. 5 rotated to its maximum with respect to the base according to some embodiments.

As shown in FIG. 8, the lid 18 may rotate in the second rotational direction from the locked position to an open position in order to expose the aperture 22. Further rotation of the lid 18 in the second rotational direction causes the engagement of the planar surfaces 68 of projections 66 with the stop surface 42 of the respective projection 38. Contact between the planar surfaces 68 and the stop surface 42 prevents further rotational movement in the second direction between the lid 18 and the base 14 creating a one-way snap-fit between the base 14 and the lid 18. Additionally, contact between the planar surfaces 68 and the stop surface 42 compresses the C-shaped members 34 around the rods 62. Once the lid 18 is coupled to the base 14, contact between the stop surfaces 42 and the planar surfaces 68, as well as the compression of the C-shaped members 34 around the rods 62, prevent the lid 18 from decoupling from the base 14. The lid 18 may rotate an angle θ with respect to the base 14. In the illustrated embodiment, the angle θ is approximately 115°. In alternate embodiments, the stop surface 42 may be angled differently with respect to the base 14 to allow for either more or less rotational movement of the lid 18.

The electrical cover 10 is configured to cover a wall utility (e.g., an electrical outlet—not shown). The base 14 is positionable proximate a wall containing the electrical outlet. The spacer 94 spaces the base 14 apart from the wall. The opening 102 of the fitting 98 is approximately the size of the electrical outlet, allowing the electrical outlet to be received through the opening 102 and positioned within the base volume of the base 14. Fittings with variously shaped openings (e.g., circular, square, etc.—not shown) may be interchanged with the fitting 98 in order to allow electrical outlets of various shapes and sizes to be positioned with the base volume of the base 14. Fastening members (e.g., threaded screws—not shown) may be positioned in the fastening apertures 26 in order to secure the electrical cover 10 to the wall. The lid 18 may pivot to the closed position so that the engagement piece 78 is coupled to the lip 21, thereby enclosing the electrical outlet within the electrical cover 10. In the illustrated embodiment, the closed position provides a substantially waterproof seal between the lid 18 and the base 14, allowing the electrical cover 10 to provide weatherproof protection (e.g., protection from precipitation) to an electrical outlet positioned in an outdoor environment.

Electrical cord(s) (not shown) may electrically and mechanically couple to the electrical outlet. A user may move the lid 18 to the open position so that the lid 18 does not cover the electrical outlet positioned within the aperture 22. The user may then insert the electrical cord(s) into the electrical outlet. Standard electrical cord(s) are taller than the side walls 20. Thus, the lid 18 is unable to close so that the engagement piece 78 couples to the lip 21 while the electrical cord(s) is coupled to the electrical outlet.

In order to accommodate both the electrical cord(s) and the electrical outlet in the electrical cover 10, a user may move the expandable portion 54 to the open position (FIG. 2). The open position of the expandable portion provides an increased volume to the electrical cover 10, that when combined with the base volume, can accommodate the electrical cord coupled to the electrical outlet.

The electrical cord(s) may be positioned within the first channel 46 while the lid 18 is opened. When the lid 18 closes, the second channel 70 aligns with the first channel 46 so that the cord(s) are positioned within the cavity 90, allowing the electrical cord(s) to extend out of the electrical cover 10 while the lid 18 is closed and the engagement piece 78 is coupled to the lip 21.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. An enclosure for providing access to an electrical outlet, the enclosure comprising:
   - a base including an aperture configured to couple to the electrical outlet;
   - a lid coupled to the base and selectively covering the aperture, the lid including a frame and an expandable section movable relative to the frame, the expandable section selectively increasing a volume of the lid, and the expandable section being over-molded onto the frame,
   - wherein the base and the lid are pivotably connected by a hinge, a female portion of the hinge disposed on a projection from the frame, the female portion including a stop surface positioned opposite of the projection on the female portion and the stop surface configured to limit movement of the lid with respect to the base.

2. The enclosure of claim 1, wherein the expandable section is formed by injection molding, the frame being formed from a different material than the expandable section.

3. The enclosure of claim 1, wherein the lid includes a male hinge component that is receivable within the female portion of the hinge, the male hinge component and the female portion of the hinge pivotably couple the lid to the base.

4. The enclosure of claim 1, further comprising a fitting having an opening, the fitting removably positionable within the aperture of the base, the electrical outlet configured to be positioned at least partially through the opening of the fitting.

5. The enclosure of claim 1, wherein the base includes a first channel and the lid includes a second channel positionable adjacent the first channel to form a cavity, an electrical cord configured to couple to the electrical outlet and pass through the cavity while the lid is covering the aperture.

6. The enclosure of claim 1, wherein the expandable section includes a tiered structure foldable on itself, the expandable section is disposed on both sides of the frame while in a folded position.

7. The enclosure of claim 1, wherein the frame is made from a rigid material and the expandable section is made from a flexible material.

8. An enclosure for providing access to an electrical outlet, the enclosure comprising:
   - a base including an aperture configured to couple to the electrical outlet, the base including at least one selected from a group consisting of a male hinge portion and a female hinge portion;
   - a lid including a flexible portion and a rigid portion, the flexible portion moveable relative to the rigid portion and being over-molded onto the rigid portion, the other of the male hinge portion and the female hinge portion coupled to the rigid portion, the male hinge portion snapped into the female hinge portion to pivotably couple the base to the lid, wherein the female portion of the hinge is disposed on a projection, the female portion including a stop surface positioned opposite of the projection on the female portion and the stop surface configured to limit movement of the lid with respect to the base.

9. The enclosure of claim 8, wherein the male hinge portion and the female hinge portion are coupled together with a one-way snap so that the male hinge portion cannot be removed from the female hinge portion once the snap is engaged.

10. The enclosure of claim 8, further comprising a fitting having an opening, the fitting removably positionable within the aperture of the base, the electrical outlet configured to be positioned at least partially through the opening of the fitting.

11. The enclosure of claim 8, wherein the flexible portion is injection molded.

12. The enclosure of claim 8, wherein the base includes a first channel and the lid includes a second channel positionable adjacent the first channel to form a cavity, an electrical cord configured to couple to the electrical outlet and pass through the cavity while the lid is covering the aperture.

13. The enclosure of claim 8, wherein the flexible portion has a first position defining a first lid volume and a second position defining a second lid volume greater than the first lid volume, an electrical cord positionable in the lid when the flexible portion is in the second position.

14. The enclosure of claim 8, wherein the flexible section includes a tiered structure foldable on itself, the flexible section disposed on both sides of the rigid portion while in a folded position.

15. The enclosure of claim 8, wherein the base includes the female hinge portion and the lid includes the male hinge portion.

16. An enclosure for providing access to an electrical outlet, the enclosure comprising:

a base including an aperture configured to couple to the electrical outlet;

a lid pivotably coupled to the base and selectively covering the aperture, the lid including a frame and an expandable section movable relative to the frame, the expandable section being over-molded onto the frame, and the expandable section selectively increasing a volume of the lid in order to accommodate a cord configured to electrically connected with the electrical outlet, wherein the base and the lid are pivotably connected by a hinge, a female portion of the hinge disposed on a projection from the frame, the female portion including a stop surface positioned opposite of the projection on the female portion and the stop surface configured to limit movement of the lid with respect to the base.

17. The enclosure of claim 16, wherein hinge includes a one-way snap so that the lid cannot be removed from the base once the snap is engaged.

18. The enclosure of claim 16, wherein the expandable section includes a tiered structure foldable on itself, the expandable section disposed on both sides of the frame while in a closed position, and disposed on a single side of the frame in an opened position.

* * * * *